United States Patent [19]

Henkhaus

[11] 4,195,880

[45] Apr. 1, 1980

[54] ARM CHAIR COASTER

[76] Inventor: Oscar E. Henkhaus, 1305 4th St., Lake Charles, La. 70601

[21] Appl. No.: 952,915

[22] Filed: Oct. 19, 1978

[51] Int. Cl.[2] ..... A47C 7/42

[52] U.S. Cl. ..... 297/194; 248/1

[58] Field of Search ..... 297/194, 153; 224/25 R; 248/1, 34 C, 396.1, 105; 108/42, 43, 47, 161; 220/85 H

[56] References Cited

U.S. PATENT DOCUMENTS

| | | | |
|---|---|---|---|
| 1,738,557 | 12/1929 | Beiling | 297/194 X |
| 2,219,974 | 10/1940 | Bellow | 248/1 X |
| 2,354,568 | 7/1944 | Allen | 248/105 |
| 2,916,184 | 12/1959 | Hartley et al. | 248/1 |
| 2,953,288 | 9/1960 | Peterson | 297/194 UX |
| 3,195,847 | 7/1965 | Squires | 248/346.1 |

FOREIGN PATENT DOCUMENTS

| | | | |
|---|---|---|---|
| 637638 | 5/1950 | United Kingdom | 297/194 |

*Primary Examiner*—William H. Schultz
*Assistant Examiner*—Peter A. Aschenbrenner
*Attorney, Agent, or Firm*—George R. Douglas, Jr.; Sherman Levy

[57] ABSTRACT

An improved arm chair coaster formed of a main plastic container or body of elongated shape and closed for retaining in bulbuous end sections a weighted quantity of sand, gravel or shot, a wood, plastic or heavy cardboard block member of square or rectangular cross section secured to a mid or intermediate portion of the main plastic body, a stabilizer plate and rivets securing the main plastic bag to the block member, and underside of the main plastic body being sprayed with a non-slip, sprayed foam rubber coating to secure it onto the arm of a sofa or arm chair, and a lip, rim, or scalloped edge extending around the flat upper surface of the block means forming a receptacle. The main plastic body may be a transparent or a translucent material and each end of the main plastic body have equal weighted amounts of the sand, gravel or shot. Velcro may be used as securing means where a Velcro section is provided on the arm chair or sofa for receiving the improved arm chair coaster of the invention.

9 Claims, 4 Drawing Figures

ARM CHAIR COASTER

CROSS-REFERENCES TO RELATED APPLICATIONS AND PRIOR DATA

There is no known prior art reference and there is no related application pending in the Patent Office, but of cursory interest to the invention are U.S. Pat. Nos. to:

Bellow—2,219,974

Beghetto—3,312,436

None of these references are anticipative over the idea of an arm chair coaster having the details, the securing structures, the seam disposed along the periphery of the main plastic body for defining an upper and lower surface, and a translucent or transparent material of the main plastic body.

BRIEF SUMMARY OF THE INVENTION

The present invention relates to a new and improved arm chair coaster for providing a receptacle holder that can be more servicable and adequately supported and secured upon the arm rest portion of an arm chair or sofa, and more particularly the invention relates to an improved arm chair coaster having a saddle shaped under-surface contour for engaging an arm rest, and having a main plastic body of elongated closed container construction having sand, gravel or shot disposed therein to weight down the arm chair coaster in engaging it securely to the arm rest. Also, the underside of the arm chair coaster is provided with a non-slip, sprayed foam rubber coating throughout the under surface of the main plastic body for engaging it onto the arm rest. Similarly and further in accordance with the invention a Velcro surface means may be provided to secure the improved arm chair coaster to the furniture arm rest. More particularly the invention relates to the above structures together with providing a thin vinyl or plastic plate or member to secure the main plastic body onto the block means forming the support surface for a receptacle. It is also particularly observed that the seam provides demarking means to define an upper and a lower side of the main plastic body and thus gives longer life, added use and structure to the arm chair coaster. Providing the main plastic body of translucent or transparent material of well known plastics also provides longer life, improved use and character to the arm chair coaster since care and respect for use of the arm chair coaster and the combination of it's elements including the weighted members such as sand, gravel or shot is found to exist.

BACKGROUND OF THE INVENTION

Coasters have long been used to provide a container service for glass, ash trays, cups, condiments, candies, peanuts and the like, whether they are used on tables, chair arms or sofa arms and the like. Devices of weighted construction have been used and known for ash trays, but have not been able to be so securely connected, attached and affixed to arm chair structures to secure such from being accidentally or unknowingly knocked off and removed from the arm chair.

By means of the present invention the arm chair coaster serves as a small table or arm of recliners, sofas and arm chairs, is found to be convenient and safe for any receptacle that may be reasonably used, eliminates need for many small tables for guests and children, fits any and all types of recliners, sofas and arm chairs, may be produced in any color of material for matching furniture, and can easily be considered as a convenience and safety item for general use such as a holder for ash trays, glasses, cups, candies, peanuts and the like.

FIELD OF THE INVENTION

An object and feature of the present invention is to provide a receptable holder that is affixedly secured onto an arm chair rest with reasonable assurences that it will so remain and to provide a convenient and safe coaster for receptacles used by occupants of the chair or sofa.

A further object of the present invention is to provide an arm chair coaster having a main plastic body of elongated construction containing a seam extending throughout a marginal or peripheral portion thereof and by so defining an upper and lower surface of the main plastic body, a non-slip, sprayed foam rubber coating may be provided to the underside of the surface for adhering onto the fabric of the arm rest.

Another object and advantage of the present invention is to provide a main plastic body of transparent or translucent material.

A further object and advantage of the invention is to provide a non-slip sprayed foam rubber coating surface on the underside of the main plastic body to provide a firm and secure saddle-relation of the coaster to the furniture.

BRIEF DESCRIPTION OF THE SEVERAL VIEWS OF THE DRAWINGS

The above and other objects and advantages of the invention will become apparent upon full consideration of the following detailed description and accompanying drawings in which.

DETAILED DESCRIPTION OF THE PREFERRED EMBODIMENT OF THE INVENTION

Figure 1:
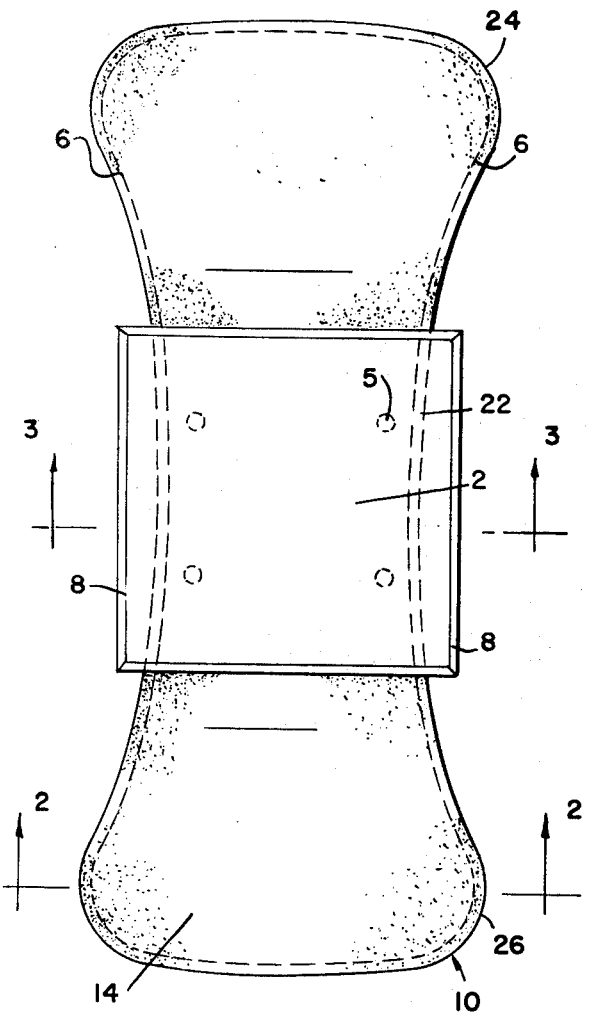
FIG. 1 is a plan view of a preferred embodiment of the improved arm chair coaster apparatus according to the best mode of the present invention.
Figure 4:
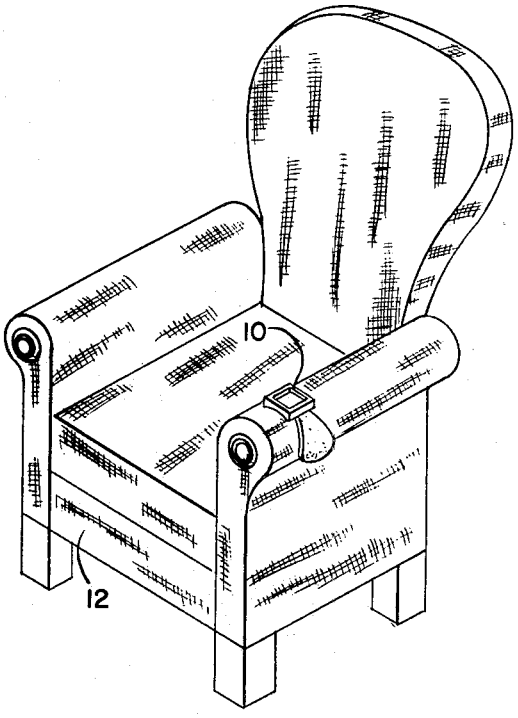
FIG. 4 is a perspective view of an arm chair showing the improved arm chair coaster disposed on an arm rest thereof according to the best mode of the invention.
Figure 2:
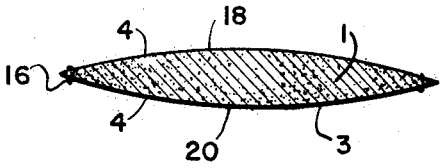
FIG. 2 is a cross section taken along lines 2—2 of FIG. 1.

Referring now to the drawings there is shown an improved arm chair coaster apparatus, an arm chair 12, an elongated closed container consisting of a main plastic receptacle or body 14 of a soft vinyl material having a peripherally disposed seam 16 sewn inwardly along an edge forming a margin thereof throughout the entire main plastic body. The seam 16 defines an upper side 18 and a lower side 20 of the main plastic body.

Figure 3:
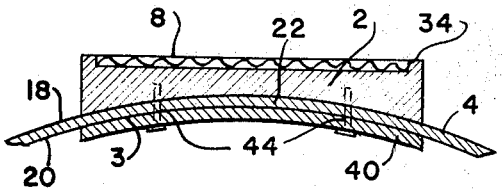
FIG. 3 is a cross-sectional view taken along lines 3—3 of FIG. 1.

The main plastic body 14 has a narrow dimension 22 along the intermediate portion and it has bulbuous end section 24,26 as shown in FIG. 1. The underside or lower side 20 has a non-slip, sprayed foam rubber coating 28 extending throughout the underside for providing an adhering surface to the arm rest of the furniture such as the arm chair 12 where it is disposed in engaging relation thereto. On the upper side 18 of the intermediate portion 22 there is disposed in engaging relation a block means 30 of wood, plastic, thick cardboard or the like which may be disposed for having an upper rim 34 in the form of a scalloped edge or safety rim structure 36 as shown in FIG. 3. Otherwise the upper surface of the block means 30 is generally flat while the underside thereof has a cylindrically contoured concave surface segment 38 for providing a saddle contour for engaging the upper convex surface arm of the arm chair 12. The intermediate narrow dimension portion 22 of the main body 14 is secured to the block member or block means 30 by means of a thin vinyl plastic stabilizer plate 40 that is secured in fixed relation to the block means 30 by means of plastic screws or split expanding rivets 44,44.

The bulbuous end portion 24,26 may contain sand, gravel or shot in equal quantities for each section so that they are equally weighted for lending adhering forces to the arm chair coaster apparatus. The main plastic body may be of translucent or transparent material or other convenient material such as a soft vinyl plastic.

The block member or means 30 may be of plastic, wood or heavy cardboard of about $\frac{3}{8}$ inches in thickness by 3 inches, or by a rectangular cross section such as 4 inches by 6 inches, respectively.

By means of the rim construction 34 the block means is provided with a safety rim for preventing objects resting on the flat surface from sliding off while in use.

By means of the construction and arrangements of the present invention, the objects and advantages and features of the present invention are achieved and realized.

Additional embodiments of the invention in this specification will occur to others and therefore it is intended that the scope of the invention be limited only by the appended claims and not by the embodiments described hereinabove. Accordingly, reference should be made to the following claims in determining the full scope of the invention.

What is claimed is:

1. Improved arm chair coaster apparatus comprising an elongated closed container consisting of a main plastic body having a peripherally disposed seam sewn inwardly along an edge forming a margin thereof, said main plastic body having a narrow dimensioned intermediate section and bulbuous end sections at each end of each said bulbuous end sections containing a quantity of weighted elements, said seam being demarking means to define an upper side and a lower side of said main plastic body, said under side having a non-slip, sprayed foam rubber coating thereon throughout it's entire under surface for providing contact with an arm of arm chairs or sofas, block means having a cylindrically contoured, concave surface segment on one side of the block means and a generally flat surface on the other side thereof forming a support surface, said concave surface segment receiving said intermediate section of said main plastic body and being secured thereon by a thin vinyl plastic stabilizer plate coterminous with the concave surface segment and being secured thereon by rivet means.

2. The invention of claim 1 wherein said weighted elements are predetermined equal amounts of sand, gravel or shot.

3. The invention of claim 1 wherein said flat surface of the block means has a rim consisting of a scalloped edge acting as a safety rim to prevent objects resting on the flat surface from sliding off while in use.

4. The invention of claim 1 wherein the rivet means are split expanding rivets to secure fast securing of the stabilizer plate onto the block means.

5. The invention of claim 1 wherein the main plastic body is of transparent material.

6. The invention of claim 1 wherein the main plastic body is of translucent material.

7. The invention of claim 1 wherein said block means has a rectangular cross section.

8. The invention of claim 1 wherein said block means has a square cross section.

9. The invention of claim 1 wherein Velcro means are provided to secure the improved arm chair coaster to furniture.

* * * * *